US009446506B2

(12) United States Patent
Tucker

(10) Patent No.: US 9,446,506 B2
(45) Date of Patent: Sep. 20, 2016

(54) TOOL HAVING DUAL FLEX HEADS

(71) Applicant: Luke R. Tucker, Deposit, NY (US)

(72) Inventor: Luke R. Tucker, Deposit, NY (US)

(73) Assignee: Walter R. Tucker Enterprises, Ltd., Deposit, NY (US)

( * ) Notice: Subject to any disclaimer, the term of this patent is extended or adjusted under 35 U.S.C. 154(b) by 239 days.

(21) Appl. No.: 14/256,739

(22) Filed: Apr. 18, 2014

(65) Prior Publication Data

US 2014/0311301 A1 Oct. 23, 2014

Related U.S. Application Data

(60) Provisional application No. 61/814,025, filed on Apr. 19, 2013.

(51) Int. Cl.
*B25B 23/00* (2006.01)
*B25B 13/46* (2006.01)
*B25F 1/00* (2006.01)

(52) U.S. Cl.
CPC ..... *B25B 23/0028* (2013.01); *B25B 13/463* (2013.01); *B25F 1/00* (2013.01)

(58) Field of Classification Search
CPC ..... B25B 23/0028; B25B 13/46; B25F 1/00
USPC ..... 81/177.8, 177.9, 125.1, 60
See application file for complete search history.

(56) References Cited

U.S. PATENT DOCUMENTS 2,951,405 A 9/1960 Engquist
4,084,456 A 4/1978 Pasbrig
D270,227 S 8/1983 Roth et al.
4,491,043 A * 1/1985 Dempsey ..... B25B 23/0035 192/45.1
5,280,740 A 1/1994 Ernst
5,522,287 A * 6/1996 Chiang ..... B25B 13/461 81/125.1
5,904,077 A 5/1999 Wright et al.
6,186,033 B1 2/2001 Faro, Sr.
6,295,898 B1 * 10/2001 Hsieh ..... B25G 1/063 81/177.8
6,761,092 B2 * 7/2004 Hsien ..... B25B 23/0071 81/125
6,877,404 B2 4/2005 Terence Chen
RE38,778 E 8/2005 Eggert et al.
D525,494 S 7/2006 Hsieh
D580,721 S 11/2008 Chen
D658,460 S 5/2012 Wang et al.
8,186,248 B1 5/2012 Considine
D677,536 S 3/2013 Liu
2006/0150784 A1 7/2006 Hsieh
2007/0062346 A1 * 3/2007 Hsieh ..... B25B 23/0035 81/177.7
2010/0107828 A1 * 5/2010 Huerta ..... B25B 13/461 81/177.9
2011/0005357 A1 * 1/2011 Chen ..... B25B 13/04 81/125.1
2011/0197714 A1 * 8/2011 Meholovitch ..... B25B 13/065 81/57.5

OTHER PUBLICATIONS

U.S. Appl. No. 13/752,514, filed Sep. 21, 2012 entitled "Rachet Wrench".
U.S. Appl. No. 14/074,716, filed Nov. 8, 2013 entitled "Hand Tool With Angle Adjusting Mechanism".

* cited by examiner

*Primary Examiner* — Hadi Shakeri
(74) *Attorney, Agent, or Firm* — Breiner & Breiner, L.L.C.

(57) ABSTRACT

The present invention relates to a tool having dual flex heads. The tool may have a flex head having a ratchet head and a flex head having a bit driver head. The flex heads may include a locking mechanism.

2 Claims, 5 Drawing Sheets

TOOL HAVING DUAL FLEX HEADS

RELATED APPLICATION

This application claims benefit of U.S. Provisional Application Ser. No. 61/814,025, filed Apr. 19, 2013, entitled "Tool Having Dual Flex Heads," and incorporated herein by reference in its entirety.

FIELD OF THE INVENTION

The present invention relates to a tool having dual flex heads. More particularly, the invention relates to a tool having a flex head having a ratchet head and a flex head having a bit driver.

BACKGROUND OF THE INVENTION

Ratchet wrenches and bit drivers are known in the art. Similarly, tools having flex heads are known in the art. However, many of these tools have shortcomings including (1) they are not versatile in use; (2) the tools having a ratchet and bit driver on the back side thereof are awkward and cumbersome to use; (3) many of the tools are short and do not provide sufficient leverage; (4) the tools cannot reach "tight" spots; and (5) similar problems.

Accordingly, the known tools while useful for certain applications have various shortcomings. These and other shortcomings of such tools are addressed by the present invention.

SUMMARY OF THE INVENTION

A primary object of the present invention is to provide a tool offering versatility by having a ratchet at one end having a flex head and a bit driver at the other end of the tool having a flex head.

Another primary object of the present invention is having a tool having a ratchet at one end of the tool having a flex head and a bit driver at the other end of the tool having a flex head wherein there is a locking mechanism for one or both of the flex heads.

Another primary object of the invention is providing a tool as set forth above having a ratchet including a specific reversing mechanism as disclosed herein.

Another primary object of the invention is providing a tool having a ¼ inch ratchet at one end to accept ¼ inch drive sockets, extensions, etc. and a ¼ inch bit driver at the opposite end which accepts ¼ inch bits and has a magnet to hold the bits in place. Each of the ends have a flex head for adjusting the application angle. The flex heads provide for 180° rotation about the handle. Additionally, the tool may include a locking mechanism on one or both of the ends of the tool for locking the flex heads into the specific desired application angle.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings.

In the drawings, like structures are not indicated by like reference numbers. Rather, each Figure uses its own reference numbers.

Figure 1:
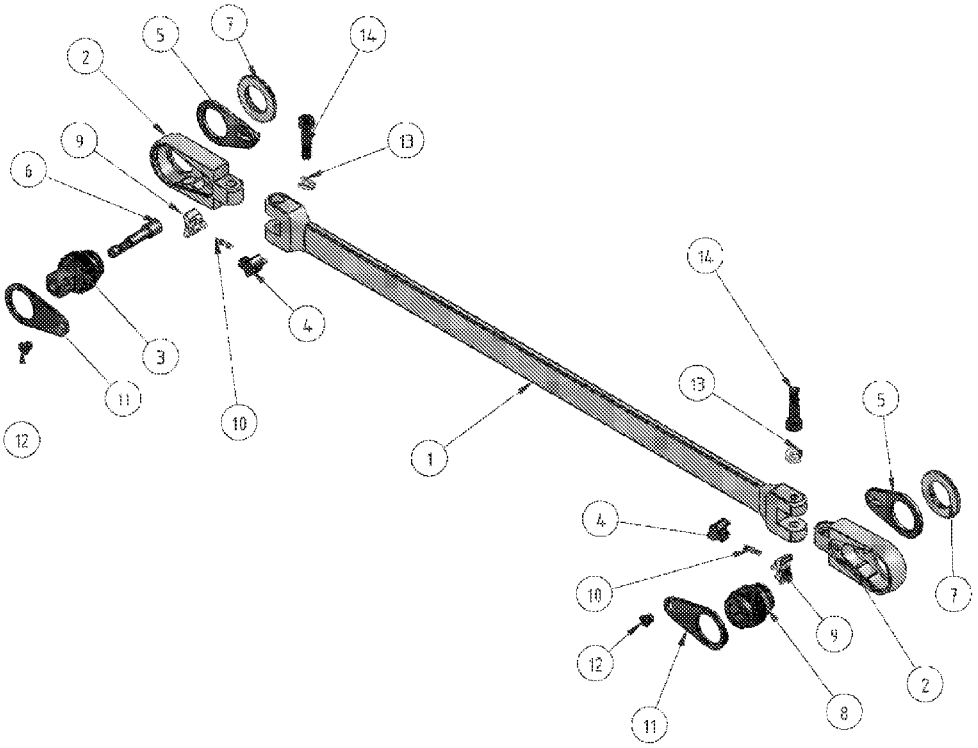

Referring to the drawings:

FIG. 1 discloses an exploded view of one embodiment of the invention having a ratchet on one end and a bit driver on the other end of the tool wherein both ends have flex heads to adjust the application angle.

Figure 2:
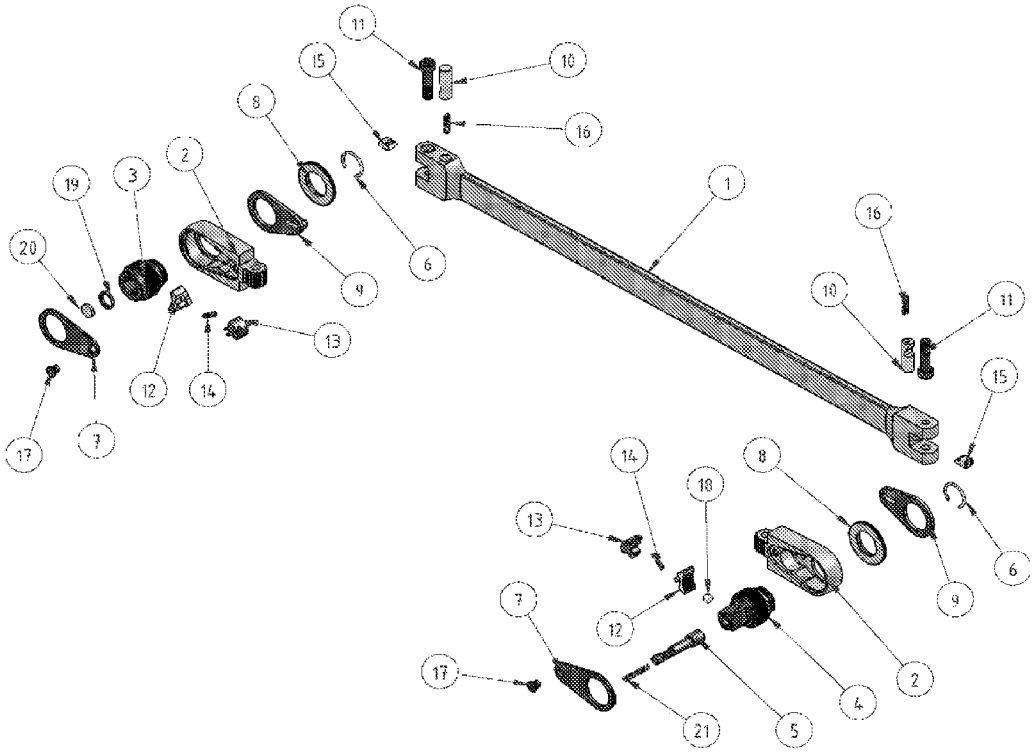

FIG. 2 discloses the invention of FIG. 1 and further includes a locking mechanism for locking the flex heads at the application angle.

Figure 3:
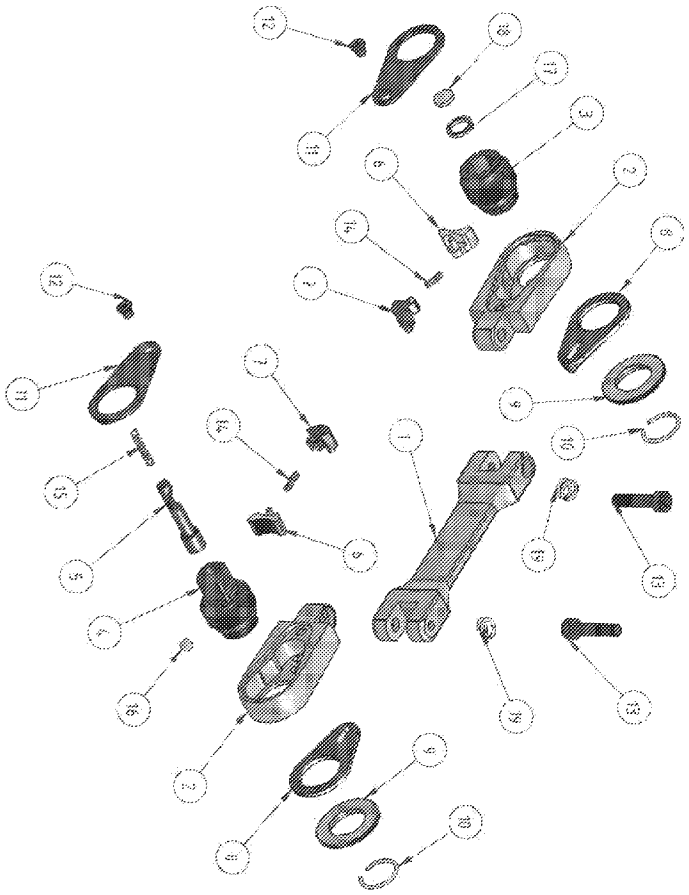

FIG. 3 is similar to FIG. 1 and shows another embodiment of the invention of a smaller size.

Figure 4:
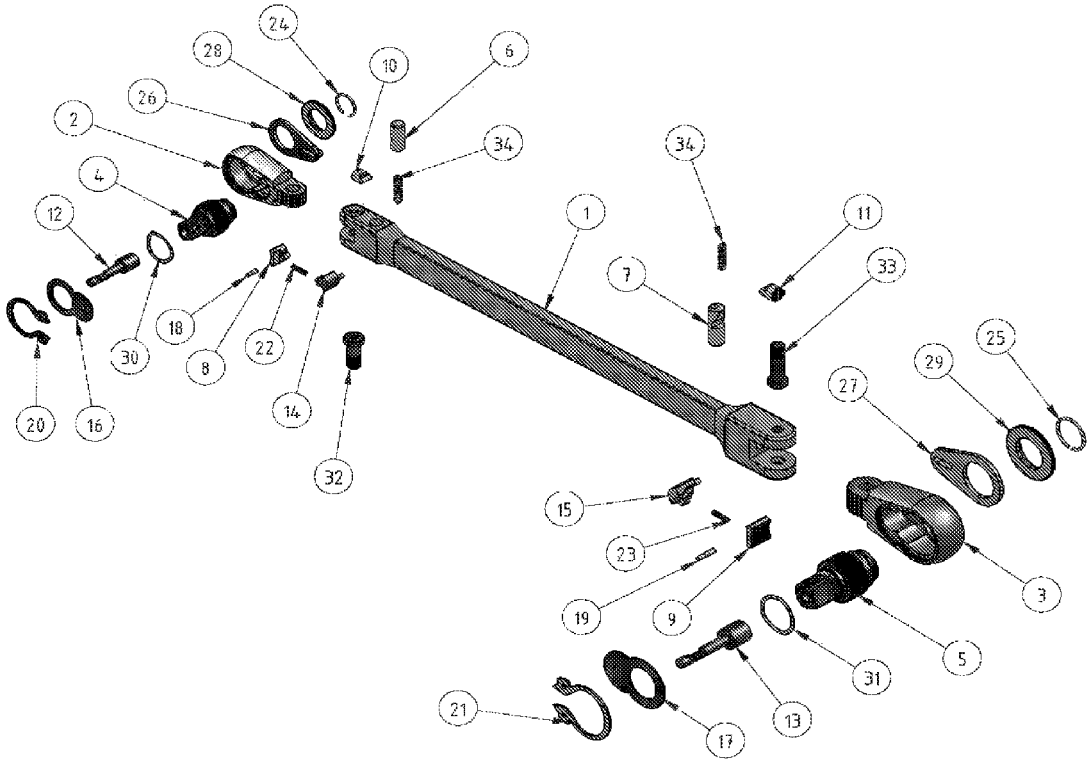

FIG. 4 illustrates a tool having a ratchet at each end of the tool of different sizes, each ratchet having a flex head to adjust the application angle, and includes a locking mechanism for locking the flex heads at the application angle.

Figure 5:
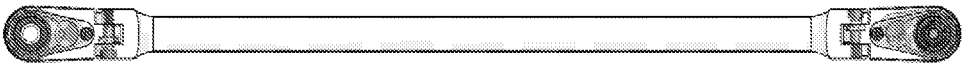

FIG. 5 discloses a side perspective view, with partial sectional views of the flex heads, of the tool of FIG. 1.

DETAILED DESCRIPTION OF THE PREFERRED EMBODIMENTS

The present invention is directed to a tool having flex heads at each end of the tool and which flex heads may be locked into a specific position. In a preferred embodiment, one flex head is a ratchet member and the other flex head is a bit drive member. However, the invention may be directed to a tool having a ratchet end of different sizes at each end of the tool.

Referring to FIGS. 1 and 5, there is disclosed one embodiment of the present invention having a ratchet on one end and a bit driver on the other end of the tool wherein both ends have flex heads to adjust the application angle. The flex heads may rotate 180° about the handle. Each end includes a reversible switch for controlling the direction of rotation of the ratchet and the bit drive. The tool may include a knurled low profile thumb wheel for extra precision in rotating the ratchet and bit drive. In the embodiment as shown in FIGS. 1 and 5, the tool is 12 inches long; the bit driver is ¼ inch and includes a magnet for holding the bit (not shown in FIG. 1 but shown in FIGS. 2 and 3); the ratchet is a ¼ inch square ratchet drive, and the ratchet includes a push button quick release. More specifically, referring again to FIGS. 1 and 5, the component parts of the tool are as follows:

1. 300 mm blade/handle
2. Flexible head
3. Socket drive
4. Spring base
5. L/R switch lever
6. Push bolt
7. Housing cover
8. Bit drive
9. Pawl
10. Spring
11. Frame cover
12. Screw
13. Compression spring
14. Hex socket screw The ratchet may be as disclosed herein or as known to those skilled in the art. One preferred ratchet construction is as disclosed in U.S. patent application Ser. No. 13/752,514, filed Sep. 13, 2013 and incorporated herein by reference in its entirety. The ratchet referred to for FIGS. 1 and 5 is applicable to FIGS. 2-4.

Again referring to FIGS. 1 and 5, the handle 1 includes ears at each end for receiving the flexible heads 2. The ears include apertures for receiving hex socket screw 14 for engaging the corresponding aperture in flex heads 2. There is also a spring 13 which fits into a recess in the flex head. The ratchet assembly is as generally disclosed as in U.S. application Ser. No. 13/752,514, filed Sep. 13, 2013, and includes a flex head 2 having therein a spring base 4, a spring 10, and a pawl 9 constructed and arranged to provide a reversible movement in conjunction with the L/R switch lever 5. Cover 7 is preferably knurled for control of rotation of the socket drive 3. The ratchet assembly is applicable to the tools disclosed in FIGS. 2, 3 and 4. Similarly, the bit drive rotation is the same.

Referring to FIG. 2, there is disclosed the invention of FIG. 1 and further includes a locking mechanism for locking the flex heads at different application angles. It is understood that different locking mechanisms will allow for a different number of locking positions of the flex heads. The component parts of this tool are as follows:

1. 300 mm blade/handle
2. Flexible head
3. Bit drive
4. Socket drive
5. Push bolt
6. C-Clip
7. Frame cover
8. Housing cover
9. L/R switch lever
10. Lock bolt
11. Hex socket screw
12. Pawl
13. Spring base
14. Spring
15. Fix rod
16. Extension spring
17. Screw
18. Steel ball for socket drive
19. Magnet mount
20. Magnet
21. Extension spring The locking mechanism may be as disclosed or as known to those skilled in the art. One preferred locking mechanism is disclosed in U.S. patent application Ser. No. 14/074,716, filed Nov. 8, 2014, and incorporated herein by reference in its entirety. The locking mechanism referred to for FIG. 2 is applicable to FIG. 4.

Referring again to FIG. 2, the locking mechanism includes lock bolt 10 having an inclined plane and recess and spring 16 which fits in a transverse hole and an ear of handle 1. The locking mechanism further includes a fix rod 15 which fits in an aperture of handle 1 between the ears and one end engages lock bolt 10 and the other end engages the lower end of the flex head which includes a pivoting portion having an arc teeth face. Pushing lock bolt 10 in allows for pivoting of the flex heads and releasing thereof locks the flex head in the desired position.

Referring to FIG. 3, there is disclosed a tool similar to FIG. 1, but of a smaller size. The component parts of this tool are as follows:

1. 120 mm blade/handle
2. Flexible head
3. Bit drive
4. Socket drive
5. Push bolt
6. Pawl
7. Spring base
8. L/R switch lever
9. Housing cover
10. C-Clip
11. Frame cover
12. Screw
13. Hex socket screw
14. Spring
15. Extension spring
16. Steel ball for socket drive
17. Magnet mount
18. Magnet
19. Compression spring Referring to FIG. 4, there is disclosed a tool having a ratchet at each end of the tool of different sizes, each ratchet having a flex head to adjust the application angle. The tool in FIG. 4 may include each of the features of the ratchet end of FIGS. 1, 2, 3 and 5 as referred to above, including the referenced locking mechanism. The component parts of this tool are as follows:

1. 300 mm blade/handle
2. ¼" head
3. ⅜" head
4. ¼" drive
5. ⅜" lock bolt
6. ¼" lock bolt
7. ⅜" lock bolt
8. ¼" pawl
9. ⅜" pawl
10. ¼" fix rod
11. ⅜" fix rod
12. ¼" push bolt
13. ⅜" push bolt
14. ¼" spring base
15. ⅜" spring base
16. ¼" frame cover
17. ⅜" frame cover
18. ¼" central axis
19. ⅜" central axis
20. ¼" c-clip
21. ⅜" c-clip
22. ¼" spring
23. ⅜" spring
24. ¼" c-clip
25. ⅜" c-clip
26. ¼" L/R switch lever
27. ⅜" L/R switch lever
28. ¼" housing cover
29. ⅜" housing cover
30. ¼" wave spring
31. ⅜" wave spring
32. Hex socket screw
33. Hex socket screw
34. Extension spring The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

The invention claimed is:

1. A tool having dual flex heads comprising:

an elongated handle portion having a first U-shaped female member at a first end of said elongated handle portion and a second U-shaped female member at a second end of said elongated handle portion and said first and second U-shaped female members are adapted to receive a male member of a first flex head and a male member of a second flex head, said first flex head having a ratchet head and connected to said first end of said elongated handle portion and said second flex head having a bit driver head and connected to said second end of said handle portion wherein said first flex head and said second flex head are adapted to rotate 180 degrees about said elongated handle portion, said first flex head and said second flex head each further comprising a locking member to hold said first flex head and said second flex head in a plurality of different locked positions, said first flex head including a reversible switch for allowing reversible rotation of said ratchet head and said second flex head including a reversible switch for allowing reversible rotation of said bit driver head, wherein said ratchet head is ¼ inch and said bit driver head is ¼ inch, and wherein said ratchet head includes a cover having a knurled portion adapted for rotating said ratchet head and said bit driver head includes a cover having a knurled portion adapted for rotating said bit driver head.

2. A tool having dual flex heads according to claim 1 wherein said bit driver head includes a magnet adapted to hold a bit.

* * * * *